US006378736B1

(12) United States Patent
Crosslin

(10) Patent No.: US 6,378,736 B1
(45) Date of Patent: Apr. 30, 2002

(54) COLLAPSIBLE FUEL CONTAINER

(76) Inventor: Ronald Crosslin, 5771 W. 50 South, La Porte, IN (US) 46350

( * ) Notice: Subject to any disclaimer, the term of this patent is extended or adjusted under 35 U.S.C. 154(b) by 0 days.

(21) Appl. No.: 09/484,465

(22) Filed: Jan. 14, 2000

(51) Int. Cl.[7] ..... B65D 37/00
(52) U.S. Cl. ..... 222/212; 222/461; 222/568
(58) Field of Search ..... 222/212, 215, 222/465.1, 568, 539, 461, 143, 481.5; 141/338, 340, 343

(56) References Cited

U.S. PATENT DOCUMENTS

| | | | | | |
|---|---|---|---|---|---|
| 3,083,877 | A | | 4/1963 | Gash | |
| 4,187,960 | A | * | 2/1980 | Bonk | 222/568 |
| 4,572,386 | A | * | 2/1986 | Marcus | 222/568 |
| 4,592,492 | A | * | 6/1986 | Tidmore | 222/212 |
| 4,775,564 | A | | 10/1988 | Shriver et al. | |
| 4,955,493 | A | | 9/1990 | Touzani | |
| 5,269,428 | A | | 12/1993 | Gilbert | |
| 5,489,046 | A | * | 2/1996 | Wickham | 222/212 |
| D372,669 | S | | 8/1996 | Mazda | |
| 5,573,129 | A | | 11/1996 | Nagata et al. | |
| 5,598,955 | A | * | 2/1997 | Reilley | 222/212 |
| 5,667,101 | A | * | 9/1997 | Barrash et al. | 222/481.5 |

* cited by examiner

*Primary Examiner*—Philippe Derakshani

(57) ABSTRACT

A collapsible fuel container for holding a fuel and funnel for delivery of the fuel. The collapsible fuel container includes a bottle having a bottom wall and a top wall. The bottle has a peripheral wall extending between and integrally coupled to the top and bottom walls. The top wall has a bore therein. A cap for removably closing the bottle has a bore therethrough. A plug seals the bore in the cap. The plug has a shape adapted to fit in the bore in the cap. A funnel portion for directing flow of the fuel from the bottle and into the automobile is adapted removably fit in the bottle.

1 Claim, 2 Drawing Sheets

COLLAPSIBLE FUEL CONTAINER

BACKGROUND OF THE INVENTION

1. Field of the Invention

The present invention relates to collapsible containers and more particularly pertains to a new collapsible fuel container for holding a fuel and funnel for delivery of the fuel.

2. Description of the Prior Art

The use of collapsible containers is known in the prior art. More specifically, collapsible containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,083,877; 5,573,129; Des. U.S. Pat. No. 372,669; U.S. Pat. No. 5,269,428; 4,775,564; and 4,955,493.

While these devices fulfill their respective, particular objectives and requirements, the aforementioned patents do not disclose a new collapsible fuel container. The inventive device includes a bottle having a bottom wall and a top wall. The bottle has a peripheral wall extending between and integrally coupled to the top and bottom walls. The top wall has a bore therein. A cap for removably closing the bottle has a bore therethrough. A plug seals the bore in the cap. The plug has a shape adapted to fit in the bore in the cap. A funnel portion for directing flow of the fuel from the bottle and into the automobile is adapted removably fit in the bottle.

In these respects, the collapsible fuel container according to the present invention substantially departs from the conventional concepts and designs of the prior art, and in so doing provides an apparatus primarily developed for the purpose of holding a fuel and funnel for delivery of the fuel.

SUMMARY OF THE INVENTION

In view of the foregoing disadvantages inherent in the known types of collapsible containers now present in the prior art, the present invention provides a new collapsible fuel container construction wherein the same can be utilized for holding a fuel and funnel for delivery of the fuel.

The general purpose of the present invention, which will be described subsequently in greater detail, is to provide a new collapsible fuel container apparatus and method which has many of the advantages of the collapsible containers mentioned heretofore and many novel features that result in a new collapsible fuel container which is not anticipated, rendered obvious, suggested, or even implied by any of the prior art collapsible containers, either alone or in any combination thereof.

To attain this, the present invention generally comprises a bottle having a bottom wall and a top wall. The bottle has a peripheral wall extending between and integrally coupled to the top and bottom walls. The top wall has a bore therein. A cap for removably closing the bottle has a bore therethrough. A plug seals the bore in the cap. The plug has a shape adapted to fit in the bore in the cap. A funnel portion for directing flow of the fuel from the bottle and into the automobile is adapted removably fit in the bottle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new collapsible fuel container apparatus and method which has many of the advantages of the collapsible containers mentioned heretofore and many novel features that result in a new collapsible fuel container which is not anticipated, rendered obvious, suggested, or even implied by any of the prior art collapsible containers, either alone or in any combination thereof.

It is another object of the present invention to provide a new collapsible fuel container which may be easily and efficiently manufactured and marketed.

It is a further object of the present invention to provide a new collapsible fuel container which is of a durable and reliable construction.

An even further object of the present invention is to provide a new collapsible fuel container which is susceptible of a low cost of manufacture with regard to both materials and labor, and which accordingly is then susceptible of low prices of sale to the consuming public, thereby making such collapsible fuel container economically available to the buying public.

Still yet another object of the present invention is to provide a new collapsible fuel container which provides in the apparatuses and methods of the prior art some of the advantages thereof, while simultaneously overcoming some of the disadvantages normally associated therewith.

Still another object of the present invention is to provide a new collapsible fuel container for holding a fuel and funnel for delivery of the fuel.

Yet another object of the present invention is to provide a new collapsible fuel container which includes a bottle having a bottom wall and a top wall. The bottle has a peripheral wall extending between and integrally coupled to the top and bottom walls. The top wall has a bore therein. A cap for removably closing the bottle has a bore therethrough. A plug seals the bore in the cap. The plug has a shape adapted to fit in the bore in the cap. A funnel portion for directing flow of the fuel from the bottle and into the automobile is adapted removably fit in the bottle.

Still yet another object of the present invention is to provide a new collapsible fuel container that can be collapsed to save room when in storage.

Even still another object of the present invention is to provide a new collapsible fuel container that contains a funnel for ease of delivery of fuel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings where in.

DESCRIPTION OF THE PREFERRED EMBODIMENT

Figure 1:
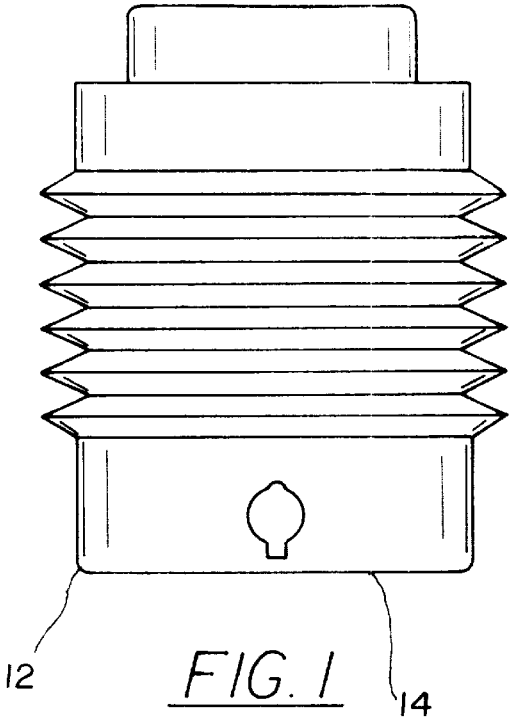
FIG. 1 is a schematic side view of a new collapsible fuel container according to the present invention.
Figure 2:
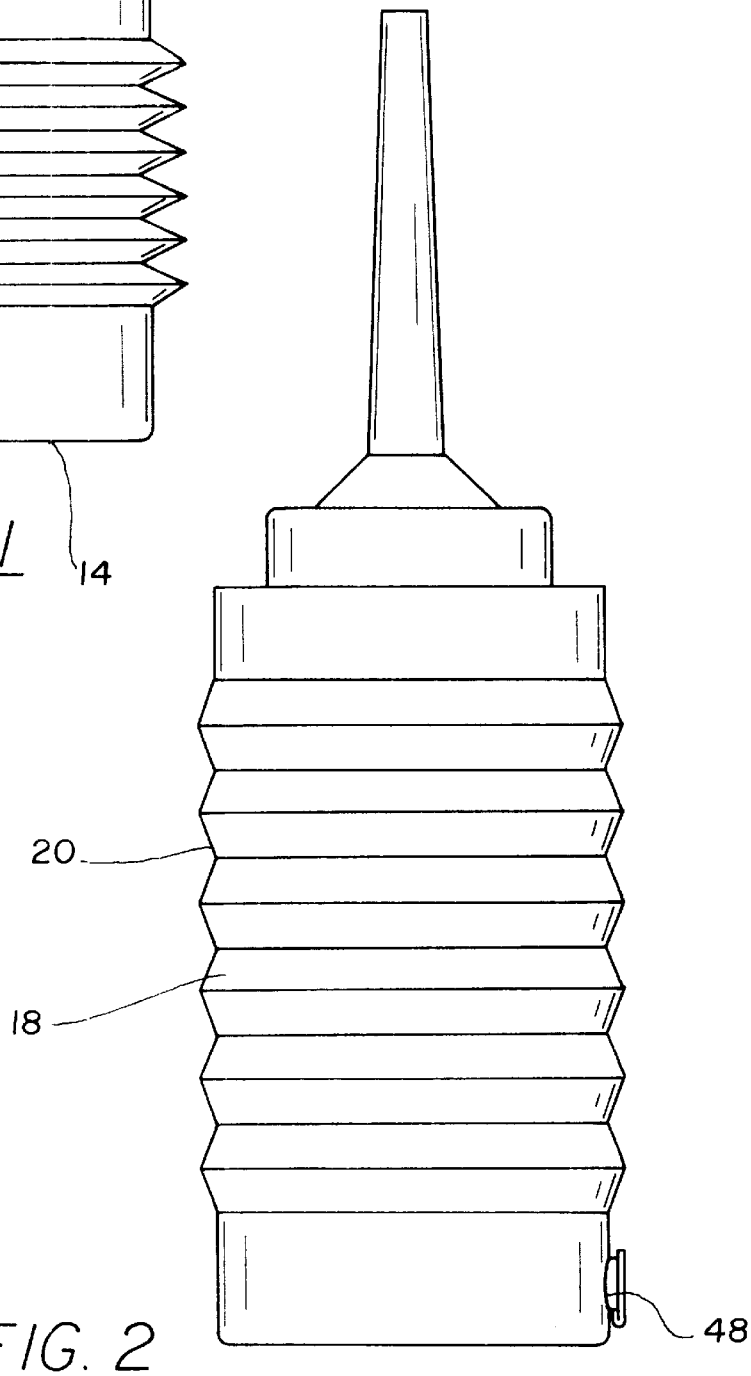
FIG. 2 is a schematic side view of the present invention.
Figure 3:
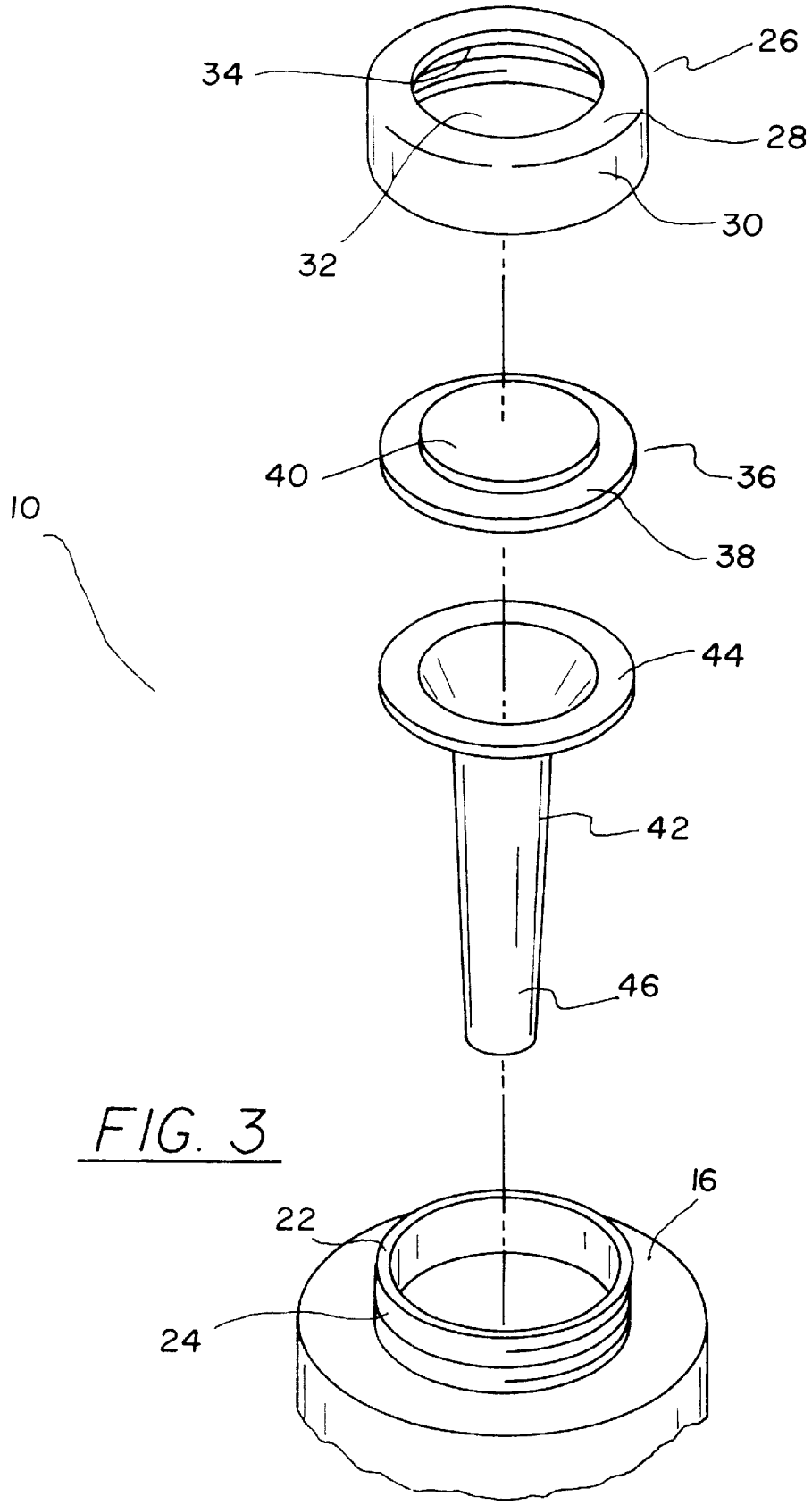
FIG. 3 is a schematic perspective view of the components of the present invention.

With reference now to the drawings, and in particular to FIGS. 1 through 3 thereof, a new collapsible fuel container embodying the principles and concepts of the present invention and generally designated by the reference numeral 10 will be described.

As best illustrated in FIGS. 1 through 3, the collapsible fuel container 10 generally comprises a bottle 12 having a bottom wall 14 and a top wall 16. The bottle has a peripheral wall 18 extending between and integrally coupled to the top and bottom walls. The top wall 14 has a bore therein. The peripheral wall 18 is corrugated such that pleat folds 20 are defined. The pleat folds have ridge and valley lines oriented generally perpendicular to a longitudinal axis of the bottle 12. The bottle 12 has a generally circular cross-section taken transverse to the longitudinal axis of the bottle. The bottle 12 is ideally formed from resiliently flexible material, such as plastic. The bottle 12 may be moved between an extended position, as best depicted in FIG. 2, and a collapsed position, as best depicted in FIG. 1.

A lip portion 22 is fixedly coupled to and extends away from an edge of the bore. The lip 22 has an exterior surface 24 which is threaded.

A cap 26 for removably closing the bottle 12 has top portion 28 and a generally cylindrical wall 30 integral therewith. The top portion 28 of the cap 26 has a bore 32 therethrough. The cylindrical wall has an interior surface 34. The interior surface 34 of the cap has threads thereon such that the cap 26 may be removably coupled to the lip portion 22. The cap 26 is preferably circular.

A plug 36 seals the bore 34 in the cap 26. The plug 36 has a shape adapted to fit in the cap. The plug 36 has a first portion 38 and a second portion 40 fixedly coupled to each other such that the second portion 40 is generally centrally located on the first portion 38. The first portion 38 is generally disc-shaped. The second portion 40 is also generally disc-shaped. The second portion 40 has a diameter generally equal to a diameter of the bore 34 in the cap 26. The first portion 38 has a diameter greater than the diameter of the second portion 40.

A funnel portion 42 directs flow of the fuel from the bottle 12 into the automobile. The funnel portion 42 has a base portion 44 and a top portion 46. The base portion 42 is generally planar and has a bore therethrough. The top portion 46 is hollow. The top portion 46 is integrally coupled to an edge of the bore in the base portion 44. The top portion is generally frusto-conical, wherein an end of the top portion generally adjacent to the base portion 44 has a diameter greater than an opposite end of the top portion 46.

A ventilation assembly is in bottle. The ventilation assembly comprises a bore in the side wall to ventilate the bottle. Preferably, the bore is generally adjacent to the bottom wall of the bottle. The bore has a removable plug 48 therein.

In use, the bottle 12 is stored in its collapsed position. The funnel 42 is kept in the bottle 12 such that the base portion 44 of the funnel rests on the lip 22 of the bottle 12 with the cap plug 36 and the cap 26 thereon. If gas is needed, the bottle 12 is taken to a gas station and filled with gas. The plug 36 and cap 26 are replaced. When at the vehicle, the cap 26 and plug 36 are removed, the funnel 42 is placed on the lip 22 of the bottle 12 and the cap 26 is replaced to hold the funnel 42 in place. The bottle 12 is turned upside down and the funnel 42 placed in the opening of the gas tank. The plug 48 from the ventilation system is removed and the gas pours into the tank.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible container for holding fuel for an automobile, said container comprising:

a bottle, said bottle having a bottom wall, and a top wall, said bottle having a peripheral wall extending between and integrally coupled to said top and bottom walls, said top wall having a bore therein, said peripheral wall being corrugated such that pleat folds are defined, said pleat folds having ridge and valley lines oriented generally perpendicular to a longitudinal axis of said bottle, said bottle having a generally circular cross-section taken transverse to said longitudinal axis, said bottle being formed from resiliently flexible material, said resiliently flexible material being plastic;

wherein said bottle may be moved between an extended position and a collapsed position;

a lip portion, said lip portion being fixedly coupled to and extending away from an edge of said bore, said lip having an exterior surface, said exterior surface of said lip having threads thereon;

a cap for removably closing said bottle, said cap having top portion and a generally cylindrical wall integral therewith, said top portion of said cap having a bore therethrough, said cylindrical wall having an interior surface, said interior surface of said cap having threads thereon, wherein said cap may be removably coupled to said lip portion, said cap being generally circular;

a plug for sealing said bore in said cap, said plug having a shape adapted to fit in said cap, said plug having a first portion and a second portion fixedly coupled to each other such that said second portion is generally centrally located on said first portion, said first portion being generally disc-shaped, said second portion being generally disc-shaped, said second portion having a diameter generally equal to a diameter of said bore in said cap, said first portion having a diameter greater than said diameter of said second portion;

a funnel portion for directing flow of the fuel from the bottle and into the automobile, said funnel portion having a base portion, and a top portion, said base portion being generally planar, said base portion having a bore therethrough, said top portion being hollow, said top portion being integrally coupled to an edge of said bore in said base portion, said top portion being generally frusto-conical, wherein an end of said top portion generally adjacent to said base portion has a diameter greater than an opposite end of said top portion; and a ventilation assembly mounted adjacent the bottom wall, said ventilation assembly comprising a bore in said side wall to ventilate said bottle, said bore being generally adjacent to said bottom wall of said bottle, said bore having a removable plug therein;

wherein the peripheral wall of said bottle has a bottom portion located adjacent to the bottom wall of said bottle, the bottom portion of said peripheral wall being substantially cylindrical, said ventilation assembly being mounted on the bottom portion of said peripheral wall.

* * * * *